US006347788B1

(12) United States Patent
Terakado

(10) Patent No.: US 6,347,788 B1
(45) Date of Patent: Feb. 19, 2002

(54) CARBURETOR WITH FUEL JET SUPPORT STRUCTURE

(75) Inventor: Hitoshi Terakado, Sendai (JP)

(73) Assignee: Walbro Japan, Inc., Tokyo (JP)

( * ) Notice: Subject to any disclaimer, the term of this patent is extended or adjusted under 35 U.S.C. 154(b) by 0 days.

(21) Appl. No.: 09/543,195

(22) Filed: Apr. 5, 2000

(30) Foreign Application Priority Data

Apr. 9, 1999 (JP) ..... 11-102293

(51) Int. Cl.[7] ..... F02M 7/02
(52) U.S. Cl. ..... 261/78.1; 261/DIG. 39
(58) Field of Search ..... 261/78.1, 44.3, 261/44.4, 35, 42, DIG. 39

(56) References Cited

U.S. PATENT DOCUMENTS

| | | | | | |
|---|---|---|---|---|---|
| 1,895,470 | A | * | 1/1933 | Mathieu | 261/DIG. 39 |
| 2,756,033 | A | * | 7/1956 | Smith et al. | 261/44.3 |
| 3,329,413 | A | * | 7/1967 | Date | 261/44.4 X |
| 3,689,036 | A | * | 9/1972 | Kikuchi et al. | 261/44.4 X |
| 4,044,080 | A | * | 8/1977 | Matsumoto et al. | 261/44.3 |
| 4,108,952 | A | * | 8/1978 | Iwao | 261/44.3 |
| 4,323,521 | A | * | 4/1982 | Morgenroth | 261/DIG. 39 |
| 4,464,313 | A | * | 8/1984 | Martineau | 261/DIG. 39 |
| 4,615,845 | A | * | 10/1986 | Tahata | 261/44.3 |
| 5,236,634 | A | | 8/1993 | Hammett et al. | 261/71 |
| 5,386,145 | A | * | 1/1995 | Boswell | 261/78.1 X |
| 5,707,561 | A | | 1/1998 | Swanson | 261/71 |
| 5,720,906 | A | * | 2/1998 | Yamanaka et al. | 261/44.4 X |
| 5,843,345 | A | * | 12/1998 | Guntly | 261/35 X |
| 5,905,423 | A | | 5/1999 | Hoppe | 335/230 |
| 5,984,281 | A | | 11/1999 | Hacker et al. | 261/71 |
| 5,988,602 | A | * | 11/1999 | Yokoyama et al. | 261/44.4 X |

FOREIGN PATENT DOCUMENTS

| | | | | |
|---|---|---|---|---|
| JP | 58-113568 | * | 7/1983 | 261/DIG. 39 |

* cited by examiner

*Primary Examiner*—Richard L. Chiesa
(74) *Attorney, Agent, or Firm*—Reising, Ethington, Barnes, Kisselle, Learman & McCulloch, P.C.

(57) ABSTRACT

A fuel jet supporting structure for a carburetor includes a support column (5) provided with a fuel passage which introduces fuel to an air intake passage (9). The fuel passage includes a fuel passage bore (24), an air passage bore (19), a threaded bore (18) and an outlet passage (16) which has subsequently reduced diameters. A stepped portion between the threaded bore (18) and outlet passage (16) is tapered. The fuel jet body (25) has a middle portion forming an emulsion tube (26) and a downstream threaded portion (28) which engages the threaded bore (18). A downstream end (27) is tapered and abuts the tapered section in the bore to form a seal.

5 Claims, 2 Drawing Sheets

CARBURETOR WITH FUEL JET SUPPORT STRUCTURE

REFERENCE TO RELATED APPLICATION

Applicant claims the priority of Japanese patent application, Ser. No. 11-102,293, filed Apr. 9, 1999.

TECHNICAL FIELD OF INVENTION

The present invention relates to a fuel jet supporting structure in a carburetor, and more particularly to a supporting structure for a fuel jet which is provided in a fuel passage communicating a fuel tank with an air intake passage in a carburetor of a fixed vacuum slidable throttle valve type or the like.

BACKGROUND OF THE INVENTION

As shown in FIGS. 3 and 4, a conventional fuel jet supporting structure in a carburetor comprises a support column 15 which projects from a lower end of a carburetor body 2 into a fuel tank 45. A fuel in the fuel tank 45 is adapted to be delivered through a fuel jet body 25 which is engaged in a fuel passage 24 formed through the support column 15 to an air intake passage 9. The fuel jet body 25 is provided at its middle portion with a fuel jet 30 for controlling the amount of the fuel flow. The fuel jet body 25 also has a plurality of radially extending holes 29 formed at its forward end portion downstream of the fuel jet 30. The air passage bore 19 communicates with the atmospheric chamber 4 through an air introducing passage 13 which is closed at an end by a ball 10, a vertically extending air inducing passage 8, and an air jet 6. The fuel is mixed with an air from the air passage bore 19 and supplied to the air intake passage 9 through an outlet passage bore 16 and passage 12 which open to air intake passage 9.

A tapered bore 20 is formed at a stepped portion between the air passage bore 19 and a threaded bore 41. A tapered shaft portion 40 of the fuel jet body 25 is engaged in the tapered bore 20 in order to prevent the fuel from leaking to the air passage bore 19 without passing through the fuel jet 30. In order to provide an airtight seal between the air passage bore 19 and the outlet passage bore 16, a projecting rib 39 having a triangular cross-section and formed at the forward end of the fuel jet body 25 is adapted to be tightly engaged in the outlet passage bore 16.

However, because the projecting rib 39 is rotatingly press-fitted into the outlet passage bore 16 with a threaded portion 41*a* of the fuel jet body 25 screwed into the threaded bore 41, the outlet passage bore 16 is likely to be deformed. Consequently, the degree of precision varies in producing the outlet passage bore 16 and thus the airtighteness between the outlet passage bore 16 and the projecting rib 39 can become deteriorated. Accordingly, there is a problem that air from the passage 13 passing into the outlet passage bore 16 may not enter into the interior of an emulsion tube 26 but instead flow into the outlet passage bore 16 through a gap between the outlet passage bore 16 and the projecting rib 39 resulting in instability of the flow rates of both the fuel and the air.

What is needed is a fuel jet supporting structure in a carburetor which has an improved seal between the inlet and the outlet of the air passage bore.

SUMMARY OF THE INVENTION

In accordance with the present invention, a fuel jet supporting structure includes a support column projecting from a bottom of a carburetor body into an interior of a fuel tank and provided with a fuel passage which introduces a fuel from within the fuel tank to an air intake passage in the carburetor body. The fuel jet supporting structure has the fuel passage and a fuel jet body received therein. The fuel passage includes a fuel passage bore receiving the fuel jet body, an air passage bore communicating with an air introducing passage of the carburetor body, a threaded bore, and an outlet passage bore which are formed in the support column downstream from the threaded bore and preferably having a diameter smaller than the threaded bore. A stepped portion of the bore lies between the threaded bore and the outlet passage bore. Preferably, this stepped portion of the bore is tapered.

The fuel jet body includes a fuel jet provided at a middle part of a fuel passage passing through the fuel jet body. An emulsion tube is formed with a plurality of radially extending holes and provided at an axial portion within the air passage bore. A threaded portion is adapted to engage with the threaded bore at its downstream portion, and a stepped shaft portion abuts against the stepped portion of the bore. Preferably, the stepped shaft portion at its downstream end face is tapered with the complementary shape of the taper of the stepped portion of the bore.

According to the invention, the fuel jet body is provided with the threaded portion at the downstream portion. The tapered shaft portion of the fuel jet body is rigidly engaged in the tapered bore which is formed in the outlet passage bore downstream of the air passage bore. Further, the fuel jet body is preferably provided with an O-ring upstream of the emulsion tube and inserted in the fuel passage bore in the support column. Thus, the air passage bore is reliably sealed at both upstream and downstream sides, and all the fuel in the fuel tank enters into the emulsion tube through the fuel jet to be mixed with the air, and flows into the outlet passage bore, whereby a stable flow rate of the fuel is achieved.

BRIEF DESCRIPTION OF THE DRAWINGS

These and other objects, features and advantages of this invention will be apparent from the following detailed description of the preferred embodiments and best mode, appended claims, and accompanying drawings in which:

DETAILED DESCRIPTION OF THE PREFERRED EMBODIMENT

Figure 1:
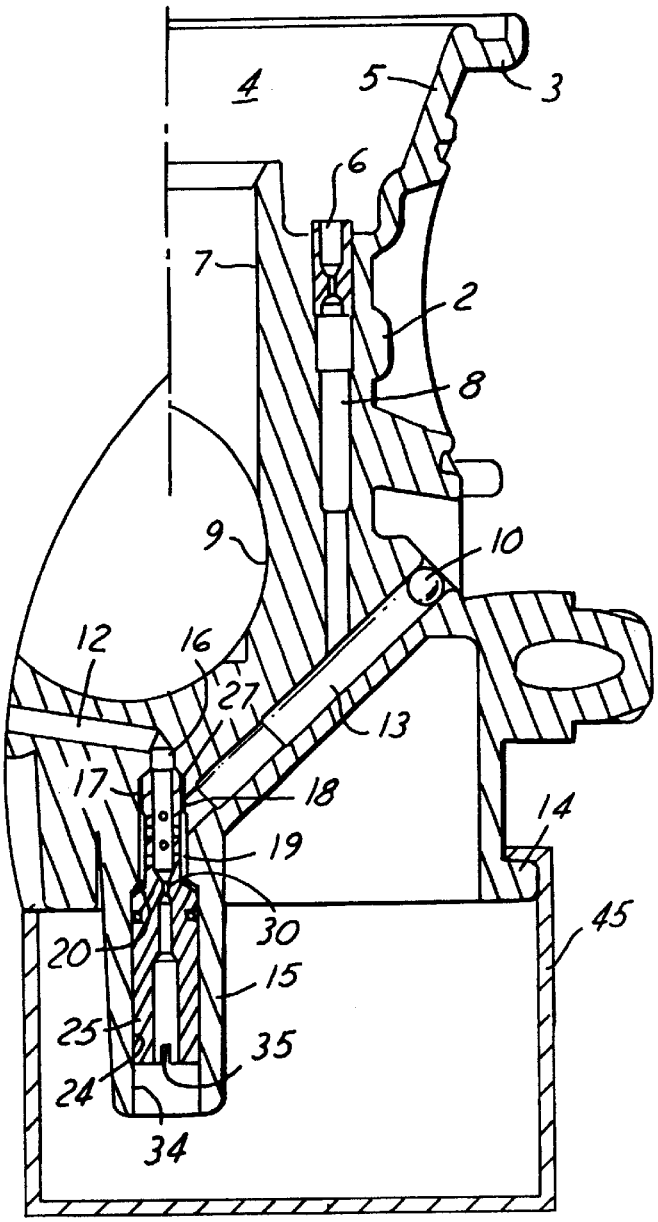
FIG. 1 is a front elevational and segmented view of a fuel jet supporting structure according to one embodiment of the invention.

Referring now to FIG. 1, a carburetor body 2 of a carburetor of a fixed vacuum slidable throttle valve type to which the invention is applicable is shown. Above a conical portion 5 is formed a vacuum chamber which is sealed with a cover plate with a known membrane clamped by its upper flange 3, and an atmospheric chamber 4 is formed below the membrane. Substantially at the center of the carburetor body is formed a vertically extending valve bore 7 which intersects with an air intake passage 9 (that extends perpendicularly to the plane of the drawing). A slidable throttle valve (not shown) whose upper end is connected to the above described membrane is mounted in the valve bore 7.

During a normal operation, an air intake pressure in the air intake passage 9 is introduced into the vacuum chamber, and the slidable throttle valve moves up and down according to a degree of negative pressure in the vacuum chamber to automatically control the amounts of the air and the fuel. A support column 15 downwardly projecting from the carburetor body 2 is inserted into a fuel tank 45. The fuel tank 45 is connected to a lower end flange 14 of the carburetor body 2 and constructed so as to always maintain a determined level of the fuel which is supplied from outside through a conventional fuel flow valve (not shown) adapted to be opened and closed by a conventionally known float (not shown).

In the illustrated embodiment, the support column 15 is provided for a priming fuel passage. The present invention can also be applied to the main fuel passage where an identical support column 15 for a similarly constructed main fuel passage may be provided in the carburetor body 2. An upper end, i.e., downstream end, of the main fuel passage communicates with the air intake passage 9. A conventional fuel adjusting needle (not shown) projects from the slidable throttle valve into the main fuel passage to control the amount of the fuel supplied from the main fuel passage to the air intake passage 9 according to the upward and downward movements of the slidable throttle valve.

A fuel passage bore 24, an air passage bore 19, a threaded bore 18, and an outlet passage bore 16 are formed in the support column 15. The bores 24,19, 18 and 16 are sequentially reduced in diameter from the lower end to the upper end, i.e., the upstream end to the downstream end. The outlet passage bore 16 communicates with the air intake passage 9 through a channel 12. At a stepped portion between the threaded bore 18 and the outlet passage bore 16 is formed a tapered bore 17.

Figure 2:
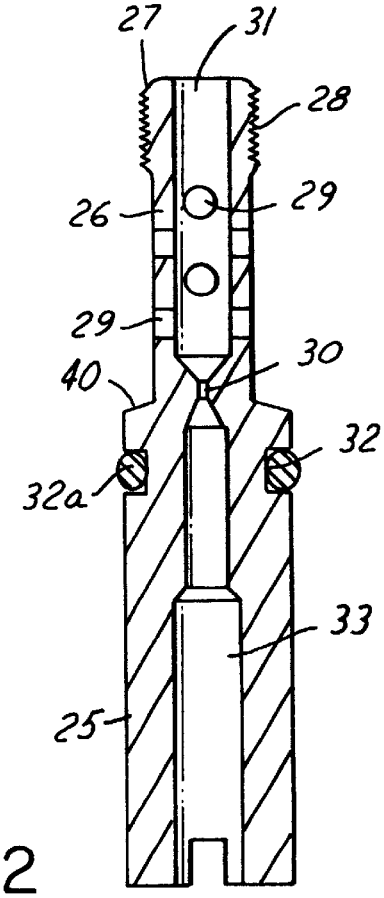
FIG. 2 is an enlarged sectional view of the fuel jet body shown in FIG. 1.
Figure 3:
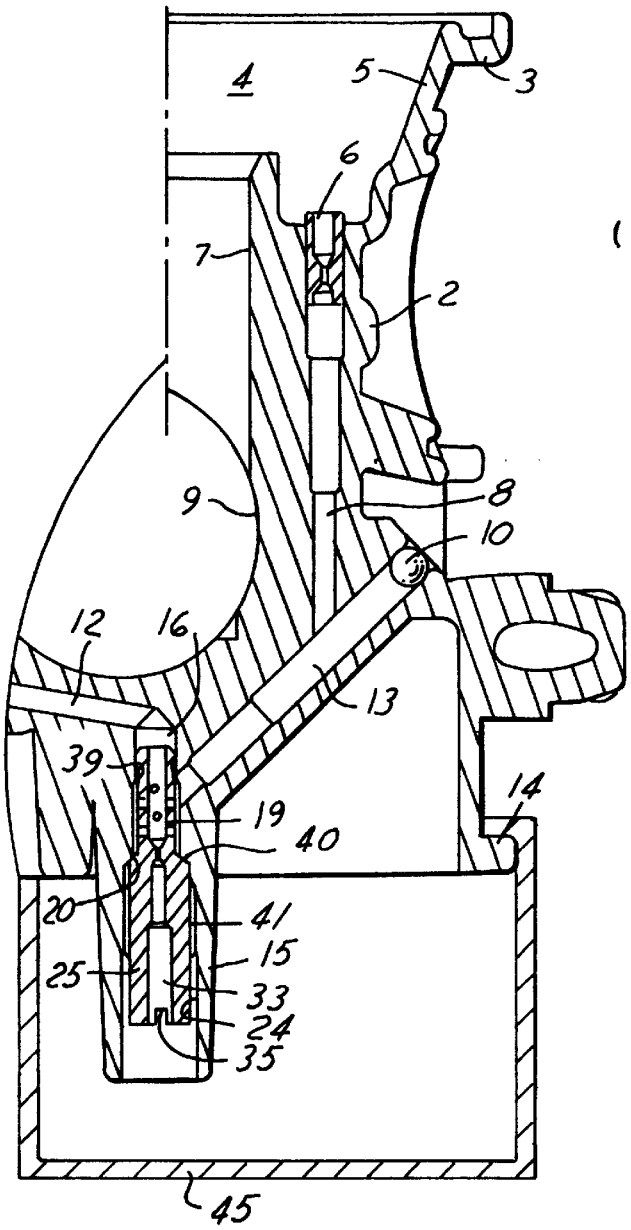
(PRIOR ART) FIG. 3
FIG. 3 is a view similar to FIG. 1 illustrating the known prior art.
Figure 4:
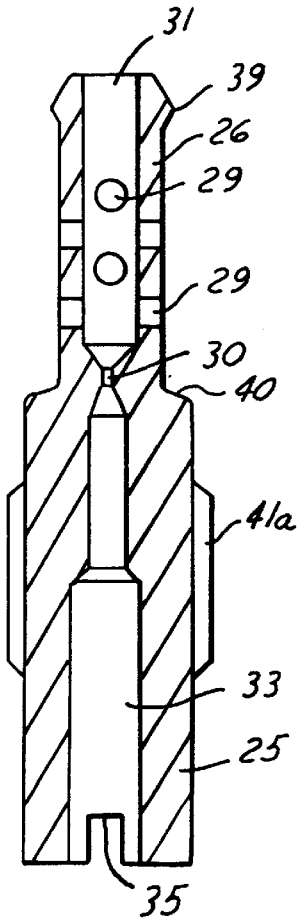
(PRIOR ART) FIG. 4
FIG. 4 is a view similar to FIG. 2 illustrating the known prior art fuel jet body.

As shown in FIG. 1, a lower base portion of the fuel jet body 25 is inserted in the fuel passage bore 24. The fuel jet body 25, as shown in FIG. 2, is provided at the middle portion with an emulsion tube 26. The emulsion tube 26 is smaller in diameter than the air passage bore 19 to define an air chamber 41 therebetween and formed with a plurality of radially extending holes 29. At an upper end, i.e., downstream end, a threaded portion 28 is adapted to engage with the threaded bore 18. A tapered shaft portion 27 is adapted to engage with the tapered bore 17. At the lower end of the fuel jet body 25, a groove 35 is formed which is adapted to hold a tool for screwing the threaded portion 28 into the threaded bore 18. Between a fuel passage 33 and a passage 31 in the emulsion tube 26 is provided a fuel jet 30 for adjusting the fuel flow rate. An O-ring 32*a* is contained in an annular groove 32 formed at an outer peripheral face of the fuel jet body 25 and elastically abutted against an inner face of the fuel passage bore 24. The fuel flowing into the passage 31 through the fuel jet 30 is mixed with the air flowing into the passage 31 from the air passage bore 19 through the holes 29, and directed to flow into the outlet passage bore 16.

As described above, according to the present invention, the threaded portion 28 and the tapered shaft portion 27 are formed at the downstream end and the upper end face of the fuel jet body 25, and the O-ring is provided at the middle portion of the fuel jet body 25. By screwing the threaded portion 28 of the fuel jet body 25 into the threaded bore 18, the tapered shaft portion 27 is abutted against and rigidly engaged with the tapered bore 17, thereby to provide a seal between the air passage bore 19 and the outlet passage bore 16. Further, the O-ring 32*a* provides a seal between the air passage bore 19 and the fuel passage bore 24.

Both upstream and downstream ends of the air chamber formed by bore 19 have a seal such that all air must pass through apertures 29 of the emulsion tube and into its interior. Therefore, a stable amount of the fuel and air can be supplied, and a low cost for manufacturing and assembling can be attained.

As compared with the conventional structure wherein the projecting rib of the fuel jet body is press-fitted in the fuel passage bore, a more stable seal can be obtained because the tapered shaft portion engages with the tapered bore only after the threaded portion of the fuel jet body is screwed and the tapered portion will be free from a damage during mounting of the fuel jet body.

Variations and modifications are possible without departing from the scope and spirit of the present invention as defined by the appended claims.

I claim:

1. A fuel jet supporting structure which comprises a support column projecting from a bottom of a carburetor body into an interior of a fuel tank and provided with a fuel passage which introduces a fuel from within said fuel tank to an air intake passage in said carburetor body, said fuel jet supporting structure comprising:

said fuel passage including a fuel passage bore receiving a fuel jet body therein;

an air passage bore communicating with an air introducing passage of said carburetor body, a threaded bore, and an outlet passage bore which are formed in said support column upstream from said threaded bore and having a diameter larger than said threaded bore; and said fuel jet body including a fuel jet provided at a middle part of a fuel passage passing through said fuel jet body, an emulsion tube formed with a plurality of radially extending holes and provided at a portion facing said air passage bore, and a threaded portion at a downstream portion which is adapted to engage with said threaded bore.

2. A fuel jet supporting structure as defined in claim 1 further comprising:

a stepped portion between said threaded bore and said outlet passage bore; and a stepped shaft portion on said fuel jet body which is abutted against said stepped portion of said bore.

3. A fuel jet supporting structure as defined in claim 2 further comprising:

said stepped portion of said bore and stepped shaft portion having complementary tapered shapes.

4. A fuel jet supporting structure as defined in claim 3 further comprising:

said fuel jet body having an O-ring seated thereabout for sealing with said outlet passage bore upstream from said stepped portion.

5. A fuel jet supporting structure as defined in claim 2 further comprising:

said fuel jet body having an O-ring seated thereabout for sealing with said outlet passage bore upstream from said stepped portion.

* * * * *